US006260236B1

(12) United States Patent
Toledo

(10) Patent No.: US 6,260,236 B1
(45) Date of Patent: Jul. 17, 2001

(54) DOOR CLOSER WITH HYDRAULIC BACK CHECKING

(75) Inventor: George F. Toledo, Fall Brook, CA (US)

(73) Assignee: Jackson Corp., Los Angeles, CA (US)

( * ) Notice: Subject to any disclaimer, the term of this patent is extended or adjusted under 35 U.S.C. 154(b) by 0 days.

(21) Appl. No.: 09/182,459

(22) Filed: Oct. 30, 1998

(51) Int. Cl.[7] ..... E05F 3/00

(52) U.S. Cl. ..... 16/53; 16/58; 16/289; 16/DIG. 21; 251/48; 251/333; 137/904

(58) Field of Search ..... 16/53, 51, 49, 16/58, 82, 71, DIG. 9, DIG. 10, DIG. 17, 60, 85, 86 R, 86 B, 80; 251/51, 48, 54; 137/904

(56) References Cited

U.S. PATENT DOCUMENTS

| | | | | |
|---|---|---|---|---|
| 1,095,370 | | 5/1914 | Bardsley . | |
| 1,177,642 | | 4/1916 | Lonbom et al. . | |
| 1,833,121 | | 11/1931 | Norton . | |
| 1,986,744 | | 1/1935 | Muxworthy . | |
| 2,114,455 | | 4/1938 | Pipia . | |
| 2,158,417 | | 6/1939 | Garrison . | |
| 2,230,661 | | 2/1941 | Wennmann . | |
| 2,615,708 | | 10/1952 | Rouverol . | |
| 2,650,386 | | 9/1953 | Edwards . | |
| 3,135,991 | | 6/1964 | Ellis . | |
| 3,246,362 | * | 4/1966 | Jackson | 16/53 |
| 3,675,270 | | 7/1972 | Jentsch . | |
| 3,701,180 | | 10/1972 | Jentsch et al. . | |
| 3,979,790 | | 9/1976 | Chiarappa . | |
| 4,003,102 | * | 1/1977 | Hawks | 16/DIG. 21 |
| 4,064,589 | * | 12/1977 | Bejarano et al. | 16/53 |
| 4,333,270 | | 6/1982 | Catlett . | |
| 4,462,437 | | 7/1984 | Prada . | |
| 4,483,044 | | 11/1984 | Johnston et al. . | |
| 4,486,917 | | 12/1984 | Johnston et al. . | |
| 4,502,180 | | 3/1985 | Harrison et al. . | |
| 4,762,149 | * | 8/1988 | Pickl | 137/904 |
| 4,773,125 | | 9/1988 | Watabe . | |
| 4,979,261 | | 12/1990 | Lasier et al. . | |
| 5,050,268 | | 9/1991 | Toledo . | |
| 5,272,787 | * | 12/1993 | Salena et al. | 16/56 |
| 5,375,813 | * | 12/1994 | Rozinsky | 251/333 |
| 5,601,275 | * | 2/1997 | Hironaka | 251/48 |
| 5,802,670 | * | 9/1998 | Bienek | 16/53 |
| 5,829,097 | * | 11/1998 | Toledo | 16/53 |
| 5,904,411 | * | 4/1999 | Hayakawa | 16/289 |

FOREIGN PATENT DOCUMENTS

| | | |
|---|---|---|
| 1807399 | 5/1970 | (DE) . |
| 2000731 | 12/1970 | (DE) . |
| 2161293 | 6/1973 | (DE) . |
| 2427114 | 12/1975 | (DE) . |
| 1221422 | 2/1971 | (GB) . |
| 2193757 | 2/1988 | (GB) . |

* cited by examiner

*Primary Examiner*—Anthony Knight
*Assistant Examiner*—Mark Williams
(74) *Attorney, Agent, or Firm*—Sonnenschein Nath & Rosenthal

(57) ABSTRACT

A resilient member, useful in a back checking arrangement, is provided as a body of resilient material having a surface engageable by an outside member such as a portion of a sliding mechanism in a door closer. The body is compressible when engaged by the outside member with a sufficient force. The body has at least one reservoir chamber therein, for receiving a liquid, such as hydraulic fluid, with a communication passage leading from the chamber to the surface to provide fluid communication between the chamber and an exterior of the body. Additional communication passages from the chamber to the exterior of the body may be provided as well. When the body is engaged by the member, the body, chamber and passage are compressed, thus causing the liquid in the chamber to exit the body through the compressing passage. This increasingly restricts the flow of liquid through the passage and increases the force of operation.

18 Claims, 4 Drawing Sheets

DOOR CLOSER WITH HYDRAULIC BACK CHECKING

BACKGROUND OF THE INVENTION

The present invention relates to back checking arrangements, and more particularly, to a hydraulic back checking arrangement for an automatic door closer.

There are currently available several types of door closing mechanisms which provide a means for regulating the opening movement of a door and to prevent an over extension of the door opening commonly referred to as back checking.

In U.S. Pat. No. 5,050,268 issued to the inventor of the present application, a back checking arrangement is provided in a door closer which includes a loosely held resilient cushion bar which is engaged by a metallic shield abutting sliding cam plates during a final few degrees of opening of a door to provide an increasing resistance against further opening of the door. The shield engages a solid, but resilient cushion bar approximately 4° prior to a normal full open position of the door. Selective thickness of the cushion bar provide either a 90° full open position of the door or a 105° full open position of the door without additional adjustment.

U.S. Pat. No. 4,064,589 to Bejarano, et al discloses a door closer in which an adjustable valve 132 is provided to regulate the back checking of the door which provides an adjustable shock absorber for the door which provides an adjustable shock absorber for the door as it reaches the fully opened position. This patent also discloses the use of a cushioning pad 157 to cushion a rearward movement of the carrier plate against the rear wall of the cam housing upon abrupt opening of the door past a normal/full open position. However, no means of attachment for the cushioning pad are disclosed.

U.S. Pat. No. 3,675,220 to Jentsch discloses a hydraulic cushioning device screwed through the door closer housing at a rear wall of the door closer housing, wherein a door closer cam forces plate-like members against the hydraulic cushioning device to slow the final stages of opening of the door. Mechanical energy of the door is dissipated to slow the door opening by throttling hydraulic fluid passing from the hydraulic cushioning device into the door closer housing, during compression of the hydraulic cushioning device.

U.S. Pat. No. 3,701,180 to Jentsch, et al discloses a door closer wherein a stud assembly comprising a compressible material replaces the hydraulic cushioning device disclosed in U.S. Pat. No. 3,675,220. Similar to U.S. Pat. No. 3,675, 220, the study assembly is screwed through the housing.

U.S. Pat. No. 3,246,362 to A. Jackson discloses a door closer which relies on a compression of springs 31 as a back checking restraint and also relies on engagement between a cam 51 and cam follower rollers 43, 44 and 45 to provide a stop at a full open position of the door.

A back checking device which comprises a loosely captured cushion bar which provides an increasing resistance to the opening of a door during the last few degrees of travel until reaching a normal full open position, is new to the art.

SUMMARY OF THE INVENTION

The present invention provides an improved back checking arrangement for the closing of the door in a door closer of a type described above in which there is a cam plate which slides longitudinally within the body of the door closer as the door is open and closed. The present invention also has utility in other environments and is not limited to use in a door closer. In many different types of constructions one member moves towards another and that movement must be slowed down and stopped. The present invention may find utility in many such constructions, particularly where it is possible to use a relatively non-compressible fluid in association with the back checking arrangement.

In a preferred embodiment disclosed in detail herein, a cushion bar fabricated of a shaped and ported resilient material is easily, loosely captured at a rear wall of the housing. A metallic shield, which is engaged to two cam follower rollers and abuts the cam plates facing the cushion bar, compresses the cushion bar when the door is opened to within a few degrees of a normal full open position. Such a normal full open position generally is selected as either 90° or 105° relative to the plane of the door jam, or the door in a closed position. The term compression, with respect to the cushion bar includes a movement in which the bar changes shape, as by flowing, but even if the solid material of the bar does not change volume.

When the door is opened to within the last few degrees of its permitted arc of travel, preferably approximately 4°, the shield will engage the cushion bar and further opening of the door will begin compression of the cushion bar. The resilient cushion bar is positioned in a chamber filled with a liquid, such as hydraulic fluid. The cushion bar has internal chambers which fill with liquid and which chambers are ported to the exterior of the bar through relatively small passages. As the door is continued to be opened through its last few degrees of travel, resistance to such travel is provided by the cushion bar, which resistance increases as the cushion bar is compressed, thus restricting the flow of hydraulic fluid out of the chambers, making the cushion bar itself less compressible.

This cushion bar arrangement provides the function of a back check valve without requiring expensive machining of the door closer body for the acceptance of a fluid-type valve and the necessary porting of hydraulic fluid as is required by the use of a reverse check valve such as that disclosed in U.S. Pat. No. 4,064,589, discussed above.

Also, the cushion bar arrangement of the present invention does not require expensive machining of the door closer body for the acceptance of screwed-in cushioning devices, such as disclosed in U.S. Pat. No. 3,675,220 and U.S. Pat. No. 3,701,180, discussed above. The deletion of devices which must be screwed into the door closure housing further provides the advantage of avoiding leakage problems, since the interior of the door closer housing is filled with a hydraulic fluid under pressure. Threaded connections into the door closer housing invite leakage problems.

As mentioned above, the cushion bar is loosely captured within the door closer housing at the rear wall of the housing as opposed to adhesively or mechanically fixing the cushion bar to the rear wall of the housing. This arrangement provides an efficient and economical approach to assembly or to replacement of the cushion bar. Differently sized dimension bars, or bars having different hardness and compressibility values can be provided in accordance with the present invention to allow for full open door angles at different positions, such as 90° or 105° and to provide different resistance responses to the opening of the door.

The present invention can be utilized in any door closer in which the cam plates slide within the door closer body and have a position close to a wall of the closer body.

DETAILED DESCRIPTION OF THE PREFERRED EMBODIMENTS

The present invention consists of an improved back checking arrangement which is illustrated in an embodiment of the spring actuated, hydraulic-pot type door closer, such as that disclosed in U.S. Pat. No. 3,246,362, which disclosure is incorporated herein by reference. The present invention provides for an improved back checking arrangement to provide a positive back checking function giving variable resistance to opening without the complexity and cost of a fluid-type valve.

Figure 1:
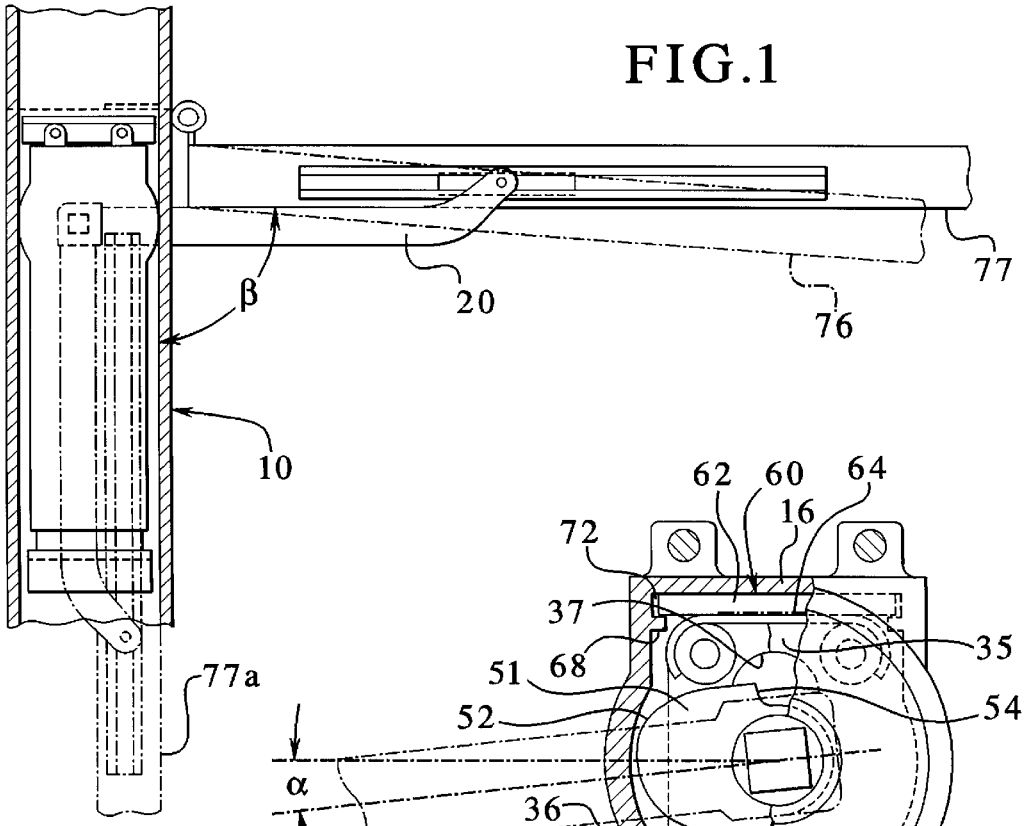
FIG. 1 is a top view of a door closer embodying the principles of the present invention which is enclosed within a door header and communicates with a door.

A door closer embodying the principles of the present invention is shown generally at 10 in FIGS. 1–4. FIG. 1 illustrating the closer 10 mounted in a concealed manner in the header portion of a door frame and illustrating the closed, nearly full open and normal full open positions of the door.

Figure 2:
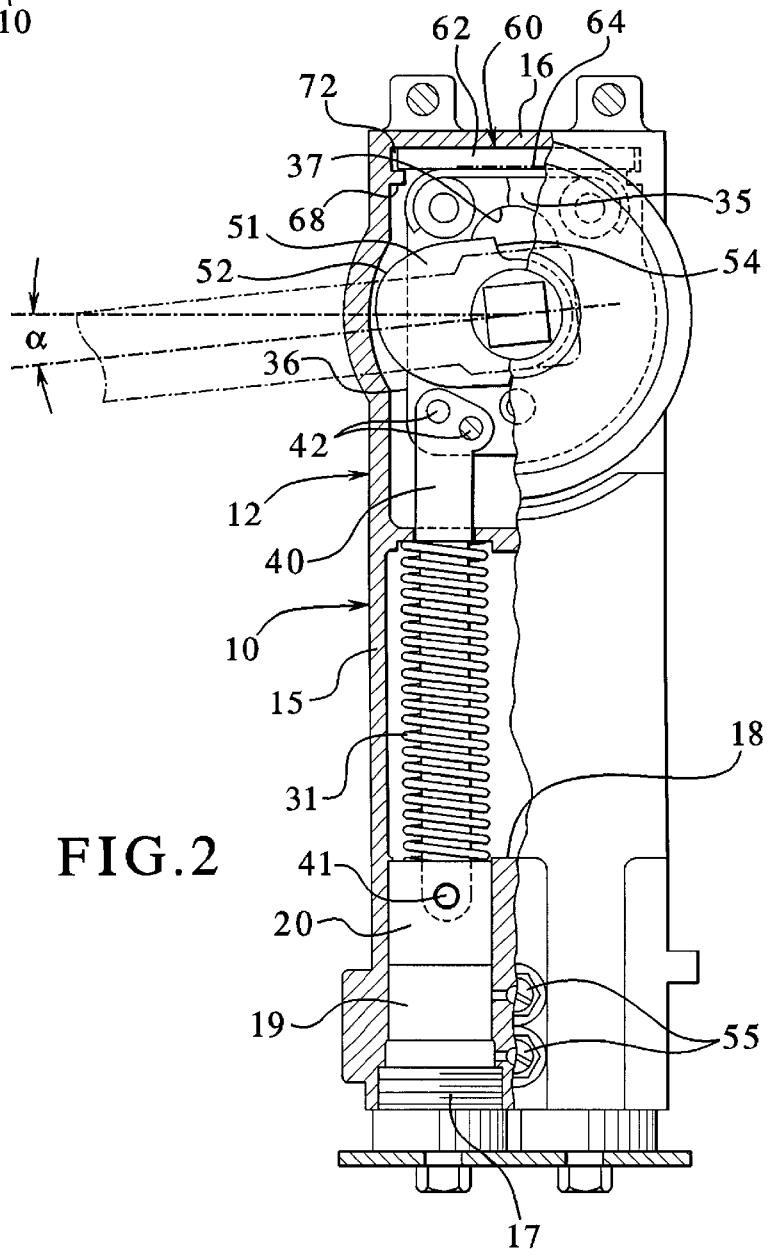
FIG. 2 is a partial sectional view of a door closer embodying the principles of the present invention showing the position of the cam plates when the door is nearly in the full open position.
Figure 3:
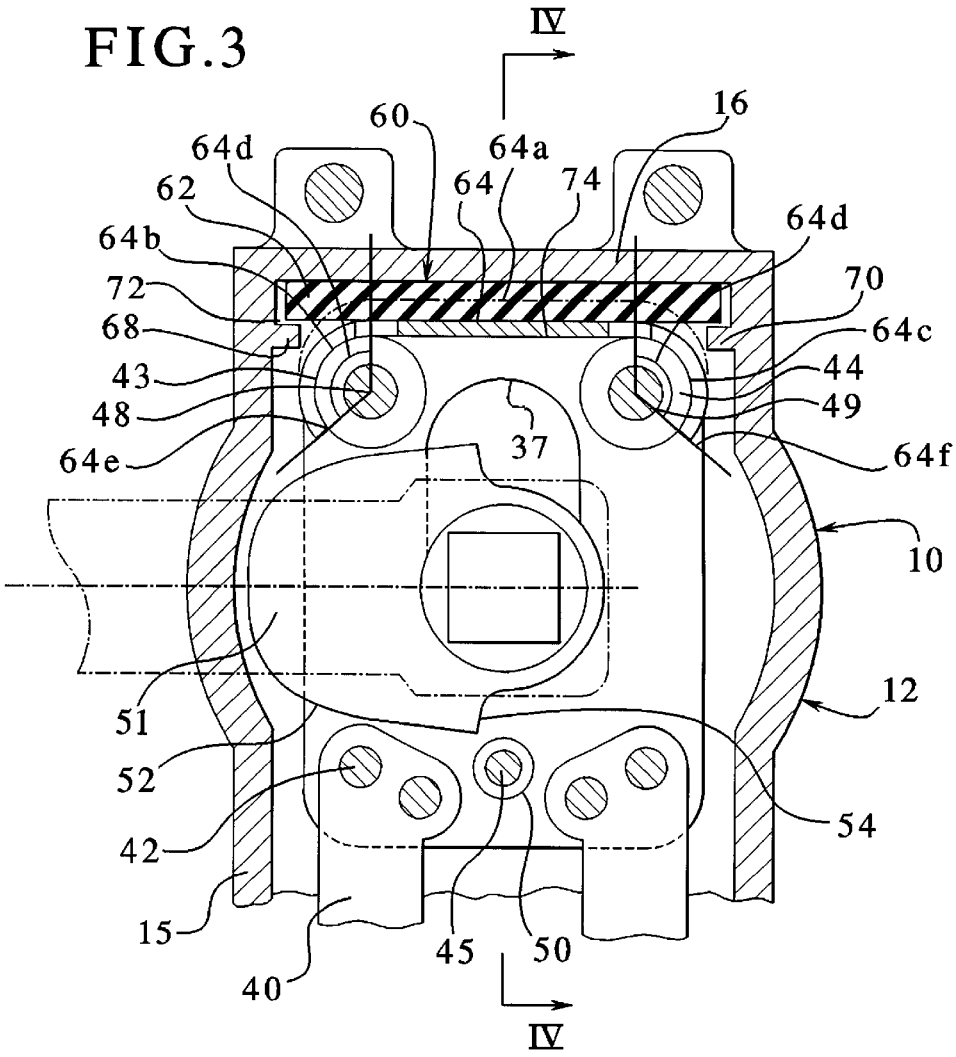
FIG. 3 is a partial sectional view of the door closer in the full open position.
Figure 4:
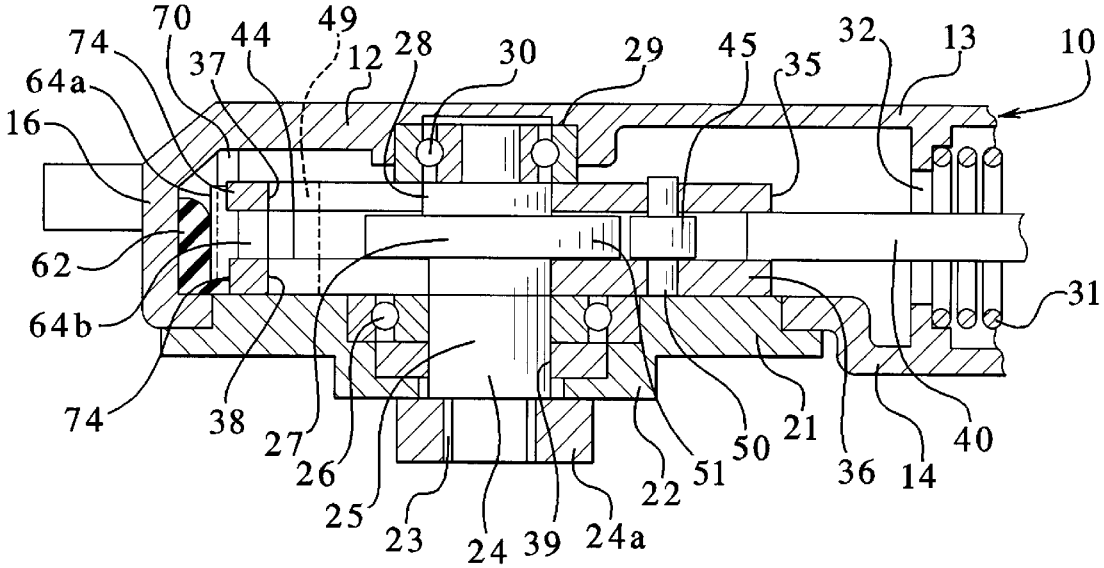
FIG. 4 is a partial side sectional view taken generally along line IV of FIG. 3.

FIGS. 2–4 show the closer in more detail where it is seen that the closer has a housing or body 12 formed of top and bottom walls 13 and 14, side walls 15, and a rear end or back wall 16, the other end wall being provided by a pair of plug members 17. The entire hollow portion within the housing forms a reservoir for a supply of oil or other non-compressible hydraulic fluid. A central partition 18 extends partially in from one end, the partition and the side walls 15 forming a pair of hollow cylinders 19 for a pair of pistons 20.

The bottom wall 14 is provided with a threaded opening in which is engaged a threaded cover plate 21, the plate having a boss 22 with a central opening 23. Extending through the opening is the spindle or door pivot member 24, this member having a non-circular end portion 24*a* for attachment to a door, such as for reception in a non-circular hole in a door hinge arm 20. The member 24 also includes a cylindrical portion 25 journaled in a ball bearing 26, a pair of shoulder or collar portions 27 and 28, and an end cylindrical portion 29 journaled in a ball bearing 30. An annular oil seal 39 is provided around the portion 25.

The closer is provided with a pair of coiled springs 31, one end of each bearing against one of a pair of internal wall portions 32, the other end bearing against one of the pistons 20. Means are provided for operably connecting the springs to the spindle member 24 and, as shown in the drawings, these means may include a pair of spaced cam plate members 35 and 36, each provided with a slot 37, 38 within each of which is received the appropriate one of the shoulders 27 and 28. A piston rod 40 is connected at one end to each of the pistons 20 by means of a pin 41. The other ends of the rods 40 are secured to the plates 35 and 36 by means of pins 42. The plates 35 and 36 are further spaced apart by means of three cam follower rollers 43, 44 and 45 mounted for rotation on respective shafts 48, 49 and 50. A cam 51 is carried on a spindle member 24 between the shoulder portions 27 and 28, the cam having a cam surface 52 with a pair of hold-closed recesses 54. Valve means 55 are provided in the central partition 18 defining the cylinders 19 to regulate the door closing and latching speeds as is discussed in greater detail in U.S. Pat. No. 3,246,362. FIG. 2 shows two separate valve members utilized for regulating the closing and latching speeds, but the present invention can also be utilized in single valve closers.

The present invention provides an improvement in regulating the back checking of the door closer, that is, regulating the amount and speed of travel of the door in the opening direction.

Figure 5:
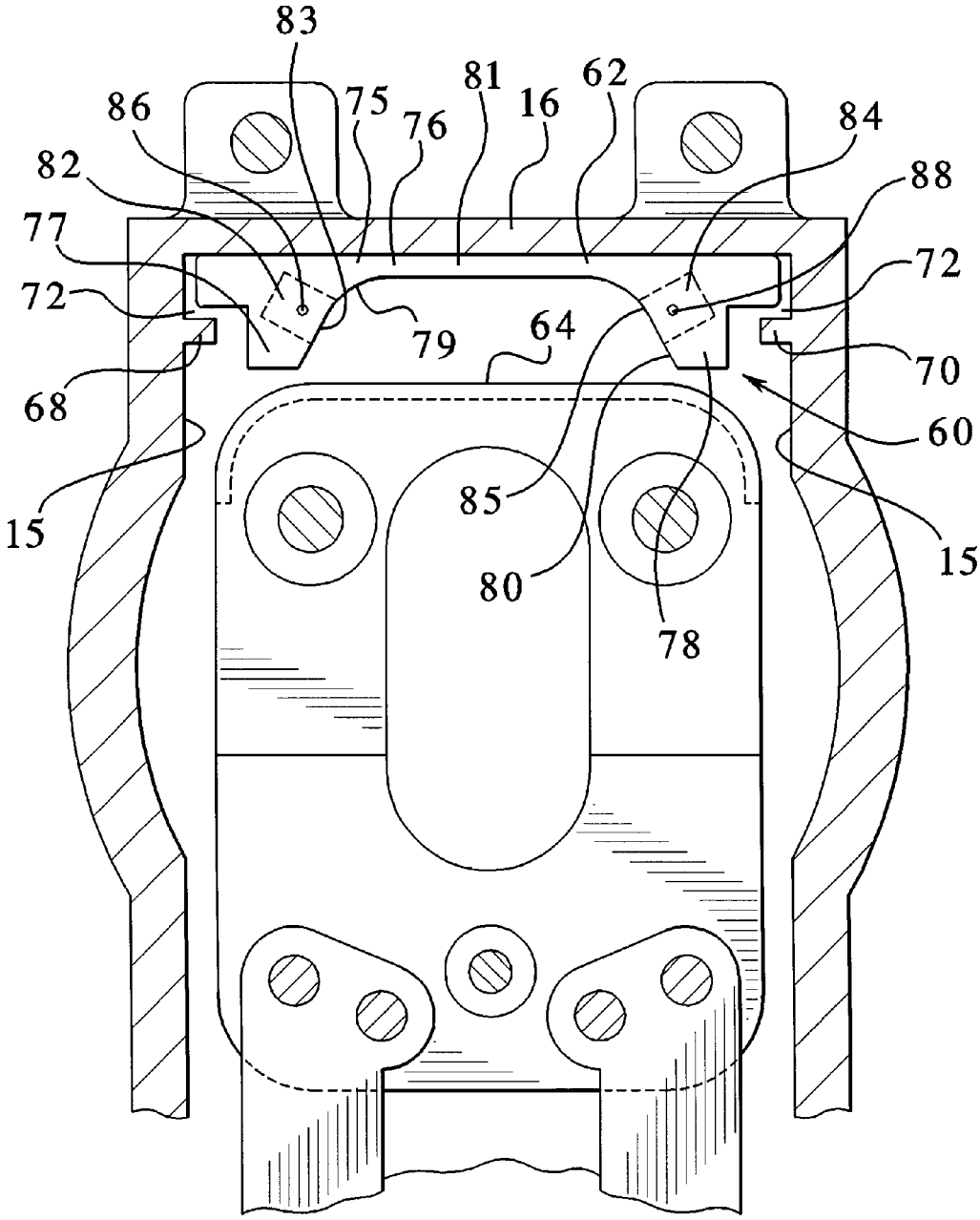
FIG. 5 is a partial sectional view of the door closer in an open portion.

As best seen in FIGS. 3, 4 and 5, the back checking arrangement provided by the present invention is illustrated generally at 60 and comprises a cushion bar 62 which is in the form of a pad of elastomeric or resilient material such as polyurethane which abuts the back wall 16 of the housing on one side and abuts a metallic shield 64 on another side opposite the back wall 16. A pair of short, opposed walls 68, 70 project inwardly from the side walls 15 of the closer body to provide a pocket 72 in which the cushion bar is captured. Separate retaining means are not required to hold the cushion bar 62 in place.

The metallic shield 64 is a generally C-shaped member and comprises a generally rectangular bearing portion 64*a* and arcuate clasp portions 64*b*, 64*c* formed of a resilient material, such as spring steel. The bearing portion 64*a* abuts a rear edge or face 74 of the plates 35, 36 and faces the cushion bar 62. The arcuate clasp portions 64*b*, 64*c* are connected to, or integral with, the bearing portion 64*a*, one at each end of bearing portion 64*a*. The arcuate clasp portion 64*b* surrounds an outward portion of a circumference of the cam follower roller 43 and the other arcuate clasp portion 64*c* surrounds an outward portion of a circumference of the cam follower roller 44. The arcuate clasp portions 64*b*, 64*c* surround the circumference of the cam follower rollers 43, 44 to an engagement angle 64*d*, sufficiently greater than 90° to prevent the shield from inadvertently disengaging the cam follower rollers 43, 44. The engagement angle 64*d* is measured between a line drawn from the center of the cam follower roller 43 toward and perpendicular to the bearing portion 64*a* and a line from the center of the cam follower roller 43 to an extreme end 64*e* of the arcuate clasp portion 64*b*. A similar method is used to draw the angle 64*d* for the arcuate clasp portion 64*c*, as shown in FIG. 3. The engagement angle 64*d* is therein measured between a line drawn from the center of the cam follower roller 44 toward and perpendicular to the bearing portion 64*a* and a line from the center of the cam follower roller 44 to an extreme end 64*f* of the arcuate clasp portion 64*c*. The engagement angle 64*d* being greater than 90° but less than 180° permits the shield 64 to be snapped onto cam follower rollers 43, 44 and removably retained thereon.

In FIG. 5, a particular embodiment of the cushion bar 62 is shown which comprises a body 75 having a relatively planar back surface 76 which abuts against the back wall 16 of the closer body 12. A front surface can be configured so as to have two forwardly projecting arms 77, 78 at lateral ends of the bar. These arms 77, 78 are connected by arcuate walls 79, 80 to a relatively thin central portion 81, thereby defining a relatively large bay area centrally between the two arms. Located in each of the arms is a chamber or space 82, 84 which can be cylindrical, rectangular or other shape, but which provides a reservoir area within the cushion bar for hydraulic fluid or other liquid. Each chamber 82, 84 has a relatively large opening 83, 85 defining a communication path from the chambers to the exterior of the body 75. Leading out from each chamber is a relatively narrow passage 86, 88 forming a second communication path from the chambers to the exterior of the body 75.

Figure 6:
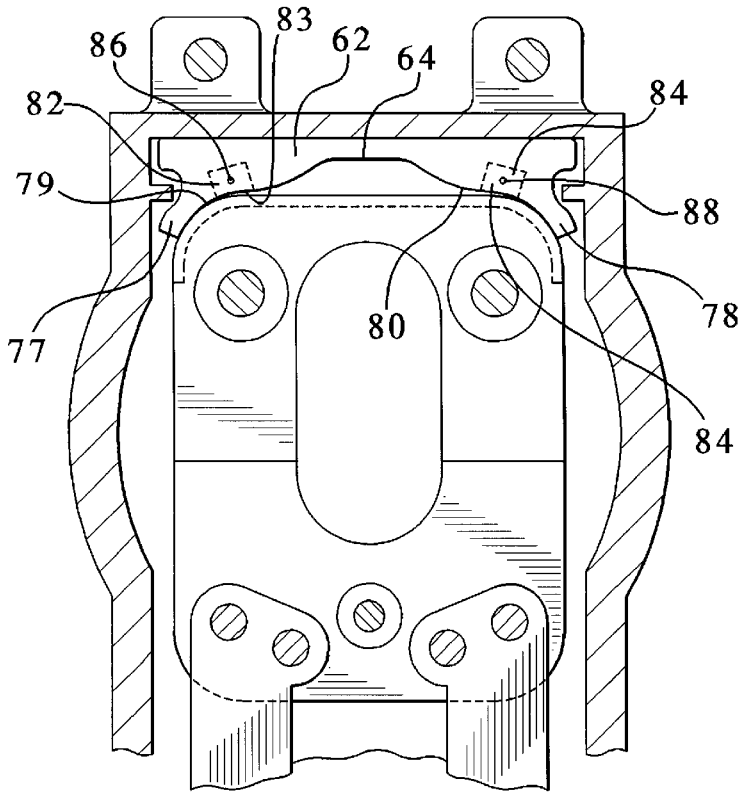
FIG. 6 is a partial sectional view of the door closer in a nearly open position.

As the metallic shield 64 moves toward and into engagement with the cushion bar 62, it will first engage the arms 77, 78 and, due to the arcuate walls 79, 80, the arms will spread toward the outside walls and the metallic shield will move into an overlying position relative to the openings 83, 85 to the chambers 82, 84, sealing them closed and preventing fluid from escaping from the reservoir chambers through the large openings (see FIG. 6). As the metallic shield is further pressed into engagement with the cushion bar, the cushion bar will be further deformed and the reservoir chamber will be forced to collapse, thus causing the liquid contained therein to flow out through narrow passages 86, 88 in a greatly restricted fashion. Thus, the resistance provided by the cushion bar will increase since the cushion bar will effectively become less compressible. As the metallic shield presses still harder against the cushion bar, even the narrow passages 86, 88 will begin to constrict, further restricting flow out of the reservoir spaces and further increasing the resistance to the metal shield by decreasing the compressibility of the cushion bar due to the liquid remaining therein.

The point at which the back checking device begins to place resistance on the opening of the door will be dependent upon the dimensions of the cushion bar and particularly the arms 77, 78, in that resistance will begin when the metallic shield first engages the arms. The amount of resistance provided by the cushion bar can be selectively modified by varying the hardness or compressibility of the cushion bar and the material from which it is made, as well as the size of the fluid reservoir chambers and the size of the narrow passages 86, 88. For example, the bar may be formed of polyurethane having a hardness in the range of 60 to 100 shore.

Figure 7:
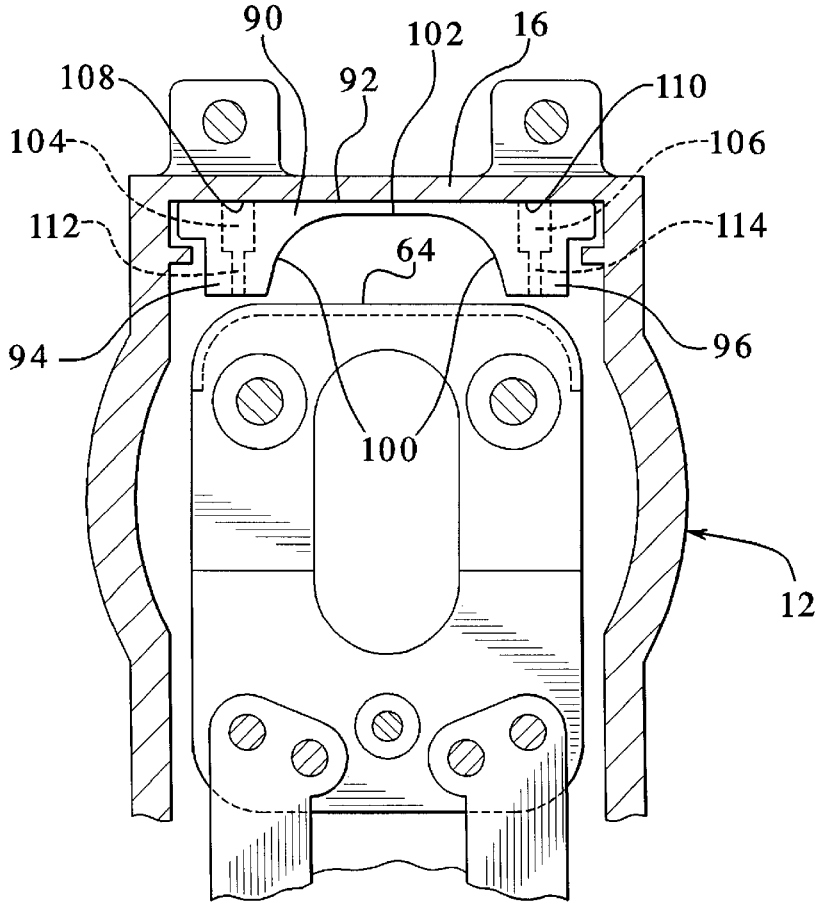
FIG. 7 is a partial sectional view of the door closer with an alternate embodiment of a cushion bar.

In FIG. 7, a second embodiment of the cushion bar is shown which comprises a body 90 which has a relatively planar back surface 92 which abuts against the back wall 16 of the closer body 12. It should be pointed out that the interior surface of the closer body 12, which is formed as a casting, has a somewhat rough surface against which the back surface 92 of the cushion bar body 90 presses. A front surface of the cushion bar body 90 again is shown to have two forwardly projecting arms 94, 96 at lateral ends of the bar. These arms 94, 96 are connected by arcuate walls 98, 100 to a relatively thin central portion 102, thereby defining a relatively large bay area centrally between the two arms. Located in each of the arms is a chamber 104, 106 which can be cylindrical, rectangular or other shape but which provides a reservoir area within the cushion bar for hydraulic fluid or other liquid. Each chamber 104, 106 has a relatively large opening 108, 110 defining a communication path from the chambers to the exterior of the body 90. Leading out from each chamber is a relatively narrow passage 112, 114 forming a second communication path from the chambers to the exterior of the body 90.

As the metallic shield 64 moves toward an engagement with the cushion bar body 90, it will first engage arms 94, 96 and, due to the arcuate walls 98, 100, the arms will spread toward the outside walls as the body begins to compress. The movement of the metallic shield toward and into engagement with the cushion bar body 90, will press the back wall 92 against the rear wall 16 of the housing body, thus generally sealing the open areas 108, 110 of the chambers 104, 106. This seal will not be complete since the surface of the rear wall 16 is not smooth, however there will be a substantial retardation of flow out of the chambers 104, 106 through openings 108, 110. As the metallic shield is further pressed into engagement with the cushion bar, the cushion bar will be further deformed and the reservoir chambers will be forced to collapse, thus causing the liquid contained therein to flow out through narrow passages 112, 114 in a greatly restricted fashion. Thus, the resistance provided by the cushion bar will increase since the cushion bar will effectively become less compressible. As the metallic shield presses still harder against the cushion bar, even the narrow passages 86, 88 will begin to constrict, further restricting flow out of the reservoir spaces and further increasing the resistance to the metal shield by decreasing the compressibility of the cushion bar due to the liquid remaining therein. Small amounts of hydraulic fluid will escape through the passages 112, 114 and small amounts will also escape out of openings 108, 110 through the imperfect seal between the back wall 92 of the cushion bar body 90 and the rear wall 16 of the closer body 12.

Again, the particular dimensions of the cushion bar body 90 can be selected to provide resistance at specific opening angles and the hardness or compressibility of the cushion bar can be modified as desired as well.

Also, in both embodiments, or other shapes as well, the number and size of the liquid reservoir chambers can be varied from a minimum of one up to any selected number depending on the size, shape and variable resistance characteristics desired. The number of communication passages leading from each chamber can be varied as well. There has to be at least one communication passage from the chamber to the exterior of the body to admit and release the liquid. In order to quickly replenish liquid when the resilient cushion bar regains its normal shape after the compressing member moves away from it, it would be desirable to have at least one relatively large passage, although that would not be absolutely necessary. In order to provide the increasing resistance, it is important to have a way of initially closing off any large passage that exists and then to begin compressing any smaller passages so that their resistance to flow will increase.

In this manner, a variably compressible resilient member is provided having at least one chamber therein, for receiving a liquid, with a communication passage leading from that chamber to a surface of the member, which passage provides fluid communication between the chamber and the exterior of the body, whereby, when the body is engaged by a movable member, the body, chamber and passage will be compressed, forcing the liquid in the chamber to exit the body through the compressing passage, thereby increasingly restricting a flow of liquid through the passage and decreasing the compressibility of the body.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

I claim as my invention:

1. In a back checking arrangement, a resilient member being variably compressible by an outside member, said resilient member comprising:

a body of resilient material having a surface engageable by said outside member and being compressible when engaged by said outside member with a sufficient force, said body having at least one reservoir space therein for receiving a liquid, with a first communication passage leading from said space to said surface to provide a first liquid communication path between said space and an exterior of said body;

said body having a second, relatively narrower communication passage leading from said space to said surface to provide a second liquid communication path between said space and said exterior of said body;

whereby, when said body is engaged by said outside member, and said body and said space are compressed, and said body causes said first communication passage to be blocked, said liquid in said space is forced to exit said body through said second passage, thereby decreasing the compressibility of said body.

2. A resilient member according to claim 1, wherein said second communication passage is arranged to be compressed along with said body and said space, thereby providing a continuously decreasing compressibility of said body as it is further compressed.

3. A resilient member according to claim 1, wherein said body has a plurality of arms projecting therefrom for engagement by said member, each arm having a reservoir space therein.

4. A resilient member according to claim 1, wherein said body has two resilient arms located at opposite ends of said body with a relatively thin portion extending between said arms with an arcuate wall connecting said arms such that as said member presses against said arms, said arms will flatten and move away from each other as they compress.

5. A resilient member according to claim 4, wherein said first communication passage for each reservoir space opens to said surface of said body at said arcuate wall, and as said arms move away from each other during compression, said openings will be blocked by said member to severely reduce any communication path through said first communication passage.

6. A resilient member according to claim 1, wherein said first communication passage has an opening at said surface on a side opposite a side engageable by said outside member, which opposite side will be pressed against a stationary wall by said outside member to effect said blocking of said first communication passage.

7. A resilient member according to claim 1, wherein said second communication passage exits said body at an area of said surface spaced away from an area engaged by said outside member.

8. A resilient member according to claim 1, wherein said body is formed from polyurethane.

9. A resilient member according to claim 8, wherein said body has a shore value between 60 and 109.

10. In a back checking arrangement, a resilient member being variably compressible by an outside member, said resilient member comprising a body of resilient material having a surface engageable by said outside member and being compressible when engaged by said outside member with a sufficient force, said body comprising:

at least one chamber space therein, for receiving a liquid, with a communication passage leading from said chamber to said surface to provide fluid communication between said chamber and an exterior of said body;

whereby, when said body is engaged by said outside member, and said body, chamber and passage are compressed, said liquid in said chamber is forced to exit said body through said compressing passage, thereby increasingly restricting a flow of liquid through said passage and decreasing the compressibility of said body.

11. A door closer for a pivotally mounted door comprising:

a housing having a back wall and defining a sealed chamber for receiving a liquid;

at least one member movable longitudinally within said housing, said member having a rigid portion at a rearward side of said member facing said back wall;

a cam within said housing which, when connected to said door, rotates in response to an opening and closing movement of said door between a closed position and a normal full open position to drivingly engage said member to move said member in a rearward direction during the opening movement of said door;

a back checking arrangement comprising a resilient and compressible body positioned adjacent to said back wall and facing said rigid portion on a side of said body facing away from said back wall, said body having at least one chamber therein for receiving said liquid and a liquid passage between said chamber and an outside of said body; and a pocket formed in said housing adjacent to said back wall to provide a space for loosely capturing said body adjacent to said back wall, said body being engageable by said rigid portion and, along with said chamber and said passage, being compressible by said rigid portion during a final few degrees of opening of said door prior to said door reaching said normal full open position, said engagement providing an increasing resistance to opening of said door during said final few degrees of opening.

12. A door closer according to claim 11, wherein said chamber includes a first communication passage leading from said chamber to said outside of said body and a second, relatively narrower communication passage leading from said chamber to said outside of said body wherein said opening at said first passage is engaged by one of said rigid portion and said back wall to close said opening when said rigid portion engages said body.

13. A door closer according to claim 11, wherein said body has a plurality of arms projecting therefrom for engagement by said rigid portion, each arm having a chamber therein.

14. A door closer according to claim 11, wherein said body has two resilient arms located at opposite ends of said body with a relatively thin portion extending between said arms with an arcuate wall connecting said arms such that as said rigid portion presses against said arms, said arms will flatten and move away from each other as they compress.

15. A door closer according to claim 12, wherein said second communication passage exits said body at an area of a surface of said body spaced away from an area engaged by said rigid portion.

16. A door closer according to claim 12, wherein said second communication passage exits said body at an area of a surface of said body engaged by said rigid portion.

17. A door closer according to claim 11, wherein said body is formed from polyurethane.

18. A door closer according to claim 17, wherein said body has a shore value between 60 and 100.

* * * * *